US008794470B2

(12) United States Patent
Wambeke et al.

(10) Patent No.: US 8,794,470 B2
(45) Date of Patent: Aug. 5, 2014

(54) CONTAINER ASSEMBLY

(75) Inventors: Alain Wambeke, Zoutleeuw (BE); Guy Lagaeysse, Seraing (BE)

(73) Assignee: N.V. Omniform S.A., Wavre (BE)

( * ) Notice: Subject to any disclaimer, the term of this patent is extended or adjusted under 35 U.S.C. 154(b) by 286 days.

(21) Appl. No.: 12/739,679

(22) PCT Filed: Oct. 27, 2008

(86) PCT No.: PCT/EP2008/064559

§ 371 (c)(1),
(2), (4) Date: Jan. 3, 2011

(87) PCT Pub. No.: WO2009/053498

PCT Pub. Date: Apr. 30, 2009

(65) Prior Publication Data

US 2011/0084072 A1 Apr. 14, 2011

(30) Foreign Application Priority Data

Oct. 25, 2007 (EP) ..... 07119341

(51) Int. Cl.
*B65D 43/26* (2006.01)

(52) U.S. Cl.
USPC ..... 220/270; 220/266

(58) Field of Classification Search
USPC ..... 220/270, 4.21, 793, 805, 269, 265, 220/257.2, 266, 268, 260
See application file for complete search history.

(56) References Cited

U.S. PATENT DOCUMENTS

| | | | | |
|---|---|---|---|---|
| 2,798,631 | A * | 7/1957 | Engel | 220/4.21 |
| 3,421,681 | A * | 1/1969 | Frank | 229/123.2 |
| 3,696,962 | A * | 10/1972 | Fehres et al. | 220/319 |
| 3,782,576 | A * | 1/1974 | Jacquemijns | 215/253 |
| 4,721,210 | A * | 1/1988 | Lawrence et al. | 206/459.1 |
| 5,377,860 | A * | 1/1995 | Littlejohn et al. | 220/790 |
| 5,425,453 | A * | 6/1995 | Dirx | 206/455 |
| 6,135,304 | A * | 10/2000 | Wyslotsky | 220/276 |
| 6,170,696 | B1 * | 1/2001 | Tucker et al. | 220/793 |
| 6,883,678 | B2 * | 4/2005 | Chou | 220/793 |
| 7,017,775 | B2 * | 3/2006 | Zettle et al. | 220/781 |
| 7,055,715 | B2 * | 6/2006 | Maravich et al. | 220/792 |
| 2002/0148845 | A1 * | 10/2002 | Zettle et al. | 220/781 |
| 2005/0269319 | A1 * | 12/2005 | Tang | 220/4.21 |
| 2006/0060578 | A1 * | 3/2006 | Church et al. | 220/4.21 |
| 2006/0278652 | A1 * | 12/2006 | Vovan et al. | 220/793 |
| 2007/0012710 | A1 * | 1/2007 | Vovan | 220/793 |
| 2007/0029318 | A1 * | 2/2007 | Ooi | 220/4.21 |
| 2007/0095848 | A1 * | 5/2007 | Galland et al. | 220/784 |

FOREIGN PATENT DOCUMENTS

| | | | |
|---|---|---|---|
| EP | 1559656 | A1 | 8/2005 |
| GB | 1473905 | A | 5/1977 |

* cited by examiner

*Primary Examiner* — Steven A. Reynolds
(74) *Attorney, Agent, or Firm* — Sughrue Mion, PLLC

(57) ABSTRACT

A container assembly having a body and a cover. The cover includes a cover rim having an inverted U-shape defining an outer flange and an inner flange separated by a top section, a lower part of the outer flange terminating in an end. The body includes a body rim defined by an upstanding inner wall and an upstanding outer wall joined to the inner wall by a top wall, a lower portion of the outer wall terminating in a gutter. The outer wall includes a recess and the outer flange includes a protrusion to enable a fitting of the protrusion into the recess. The outer flange includes a tab extending parallel to the top section and arranged at the lower part of the outer flange. The outer flange has weakening lines to allow a tear out of a section of the outer flange.

3 Claims, 1 Drawing Sheet

CONTAINER ASSEMBLY

CROSS REFERENCE TO RELATED APPLICATIONS

This application is a National Stage of International Application No. PCT/EP2008/064559 filed Oct. 27, 2008, which claims priority from European Patent Application No. 0711934.1, filed Oct. 25, 2007, the contents of all of which are incorporated herein by reference in their entirety.

The present invention relates to a container assembly comprising a body and a cover which cover comprises a cover rim having a substantially inverted U-shape defining an outer flange and an inner flange separated by a top section, a lower part of said outer flange terminating in an end, which body comprises a body rim being defined by an upstanding inner wall and an upstanding outer wall, which outer wall being joined to said inner wall by a top wall, a lower portion of said outer wall terminating in a gutter.

There exist various forms of reusable containers with different sealing means between the cover and the container body. These containers have various purposes and therefore exist in different sizes and with different shapes. Often it is wanted to perceive if a container have been opened already for the first time. Therefore these containers are provided with a tamper element that has to be damaged or broken before the container can be opened. Typically, such a tamper element consists of a flange that has to be ripped away, the flange extending over the whole circumference of the container.

Often when one picks up a container assembly, he or she takes hold of the cover and body rim which are engaged. The cover and body rim which are engaged therefore have to be shaped in such a manner as to prevent the container assembly to open when one picks up the container assembly in such a way. Therefore the cover and body rim which are engaged have to be shaped in such a manner as to prevent the user from applying a force on the cover rim without applying a force on the body rim, especially in picking up the container assembly. To this purpose, the body rim is shaped so as to form the complete underside of the cover and body rim which are engaged. This results, when one picks up the container assembly taking hold of the cover and body rim which are engaged, in applying a force on the body rim, which does not open the container assembly.

The British Patent GB 1 473 905 discloses a container assembly wherein a complete removal of the cover will be accompanied by a separation of a peripheral portion of the container from the body thereof, thus preventing reclosure after such intentional tampering without leaving a tell-tale omission of a portion of the container, when viewed with others on display.

In an initial configuration, the body rim is defined by an upstanding inner wall and an upstanding outer wall, which outer wall is joined to the inner wall by a top wall having a weakening line. When one opens this container, the outer wall and a part of the top wall gets separated. So in a subsequent configuration, the body rim is only defined by the upstanding inner wall and a part of the top wall. So in the initial configuration, the container assembly closes at two flanges, namely the inner wall and the outer wall. However in the subsequent configuration, in reclosing, the container assembly only closes at one flange, namely the inner wall. This results in a less reliable closing of the container. Also in the initial configuration, the complete underside of the cover and body rim which are engaged is formed by the body rim. However in the subsequent configuration, in reclosing, only half of the underside of the cover and body rim which are engaged is formed by the body rim so as to allow one to accidentally open the container assembly by picking it up.

Another disadvantage is that when the cover and body are engaged, friction prevents them to open up. This friction force is caused by two substantially vertical surfaces, namely the vertical inner wall of the body and the inner wall of the cover, and therefore is not large, which results in a weak closing of the container assembly.

It is an object of the present invention to provide a container which has tell-tale means which allow one to detect that the container assembly has already been opened, which allows a reliable closing and reclosing of the container, and which is provided for being picked up taking hold of the rim without opening up.

Therefore the invention is characterized in that said outer wall comprises a recess and said outer flange comprises a protrusion in such a manner as to enable a fitting of said protrusion into said recess, said end being provided for engaging said gutter, said outer flange comprises a tab which extends substantially parallel to said top section, said tab being arranged at said lower part of said outer flange, said outer flange having weakening lines so that by applying a pulling force to said tab, a tear out of a section of said outer flange occurs. The weakening lines are provided to break upon opening the container, which allows one to detect the container already being opened. Because opening the container assembly does not affect the structure or shape of the flanges, a reliable reclosing is obtained. The recess and protrusion fitting into each other allow a more reliable closing and reclosing as it increases the frictional force between the surfaces. Because the end engages into the gutter and the gutter is provided on the body rim, the body rim engages the complete underside of the cover. This allows one to pick up the container taking hold of the cover and body rim which are engaged, without the container opening up.

Because the end engages into the gutter, the cover has no part, except for the tab, which can be taken hold of to open up the container. Because the tab is the only element to take hold of for opening up the container, and the tab is accompanied by two weakening lines, opening up the container always damages or breaks the weakening lines as there is no other way to open up the container then to use the tab. This setup guarantees the user of the container that the detecting means work properly in normal use.

The invention will now be described in more details with respect to the drawings illustrating some preferred embodiments of a container assembly according to the present invention. In the drawings.

In the drawings a same reference number has been allocated to a same or analogous element.

Figure 1:
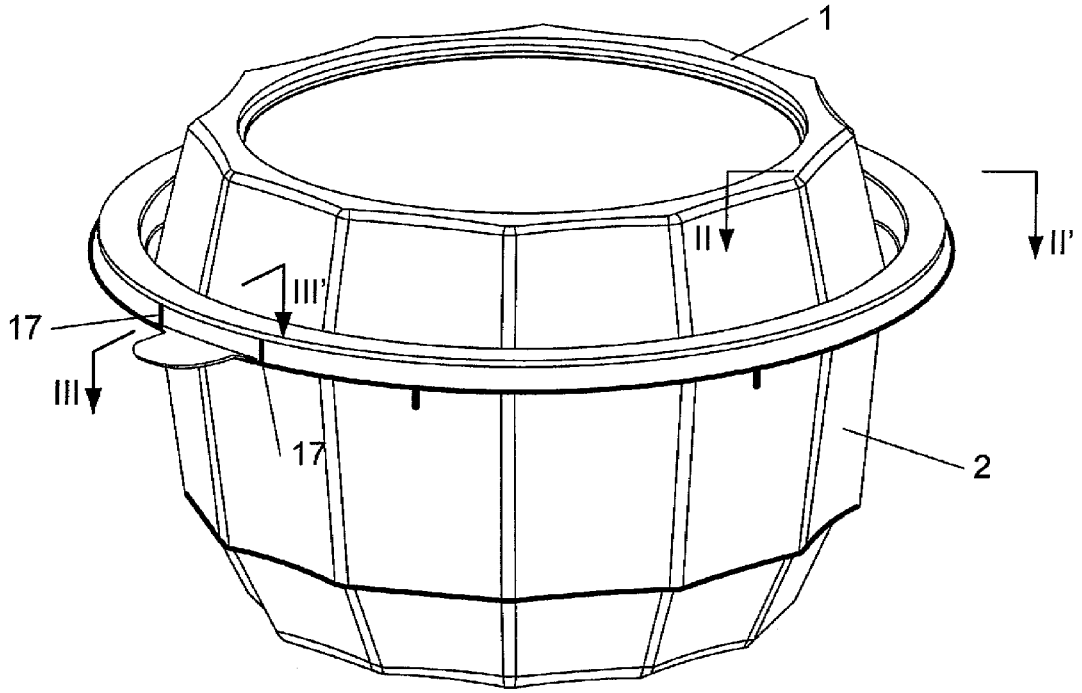
FIG. 1 illustrates a container assembly according to the invention.

FIG. 1 shows a container assembly having a cover 1 and a body 2. The cover 1 and body 2 both comprise a cover and body rim which are engaged. The cover rim 5 and the body rim 4 being complementary so as to enable the cover 1 to be attached to the body 4.

Figure 2:
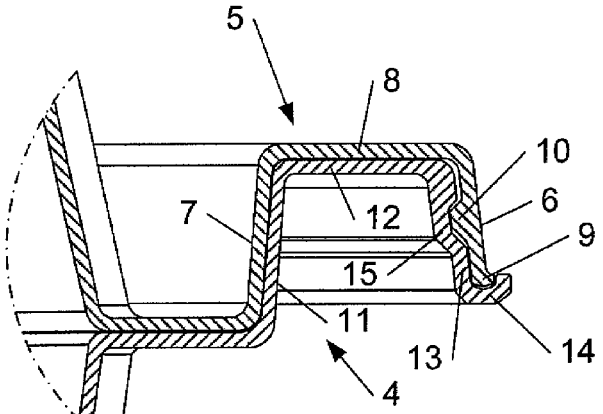
FIG. 2 illustrates a cross section of a cover and body rim which are engaged of a container assembly according to the invention.

The shape of the cover and body rim which are engaged is shown in FIG. 2. The figure shows a cross section along line II-II' of a cover rim 5 attached to a body rim 4. The cover rim 5 has a substantially inverted U-shape. This U-shape is defined by an outer flange 6 and an inner flange 7 which are linked by a top section 8. A lower part of the outer flange 6 terminates in an end 9. The outer flange 6 comprises a protrusion 10 which extends horizontally along at least a part of the outer flange 6. The protrusion 10 extends at the inner side of the outer flange 6.

The body rim 4 is formed by an upstanding inner wall 11 joined to an upstanding outer wall 13 by a top wall 12. A lower portion of said outer wall 13 terminates in a gutter 14 extending outwardly of the body 2. The outer wall 13 comprises a recess 15 at the outer side of the outer wall 13 and which recess 15 extends horizontally along at least a part of the outer wall 13. The two upstanding walls 11 and 13 and the inverted U-shape are preferably formed so as to contact each other along the complete contour of the rim. This makes it nearly impossible for water and air to penetrate into the container assembly when the cover 1 and body 2 are engaged.

The recess 15 and the protrusion 10 are formed to be able to engage into each other when the cover 1 is placed on the body 2. Therefore the recess 15 and the protrusion 10 are both positioned on that side of the rim which contacts the complementary rim when engaged.

The gutter 14 is formed in such a manner as to enable the end 9 of the cover rim 5 to engage into the gutter 14 when the cover 1 is placed on the body 2. This gutter 14, which is part of the body rim 4, then forms the lowest and widest part of the body and cover rim which are engaged, as it edges the end 9 of the cover rim 5.

When the rim of a container assembly according to the invention is taken hold of, to lift up the container assembly, there is no pulling force on the cover which could release it from the body rim 4. This is because the body rim 4 extends along the complete underside of the cover rim 5. So in lifting up the container assembly taking hold of the cover and body rim which are engaged, a force is applied on the body rim 4 and not on the cover rim 5. This applied force then does not open the container assembly.

Figure 3:
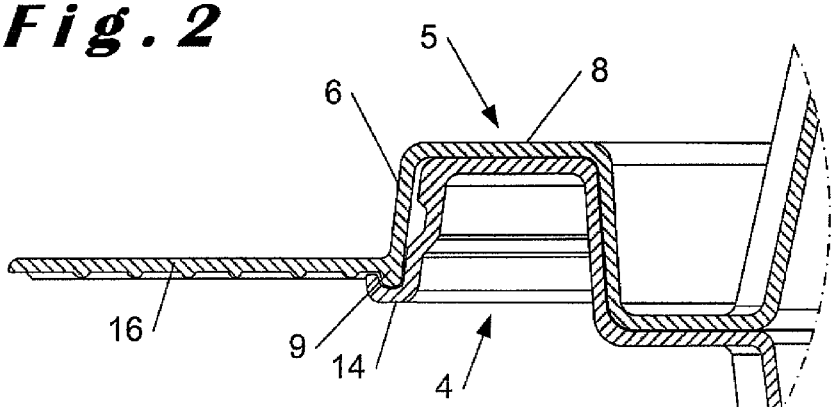
FIG. 3 illustrates a cross section of a cover and body rim which are engaged and a tab of a container assembly according to the invention.

The outer flange 6 of the cover 1 also comprises a tab 16. A cross sectional view of an engaged cover and body rim, at the level of the tab 16, is shown in FIG. 3. The tab extends substantially parallel to the top section 8 of the cover rim 5. The tab 16 is arranged at a lower part of the cover rim 5 in such a manner as to still allow the end 9 to engage into the gutter 14. The tab 16 is positioned so as to contact the gutter 14. The tab 16 has a surface area which allows a user to easily handle this tab 16 to open up the container.

The outer flange 6 has, on both sides of the tab, two substantially vertical weakening lines 17. These weakening lines 17 are formed so as to break when one opens up the container by pulling the tab 16. To open up the container, one has to pull the tab 16 upwards. This results in a force which tears out a section of the outer flange 6 by breaking the weakening lines 17. Because breaking the tab 16 does not affect the two upstanding walls 11 and 13 and the inverted U-shape, the contact area between the cover rim 5 and body rim 4 stays the same. Therefore even if the tab 16 is broken, it stays nearly impossible for water and air to penetrate into the container assembly when the cover 1 and body 2 are engaged.

Figure 4:
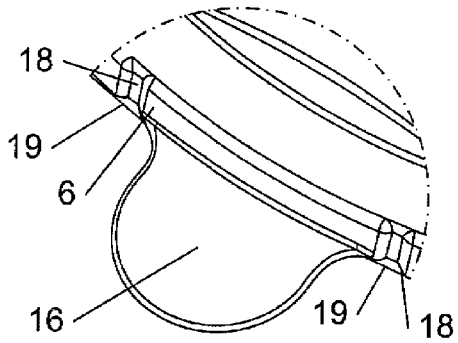
FIG. 4 illustrates a container assembly having a tab according to the invention.

The weakening lines 17 are preferably formed by a cut-out 18 as shown in FIG. 4. The cut-out 18 starts next to the tab 16 at the end 9 of the cover rim 5 and runs vertically upward to the top section 8. The cut-out 18 is preferably bridged by a bridge 19 extending in line with the end 9. The bridge 19 is preferably formed so as to break when one pulls the tab 16.

The invention claimed is:

1. A container assembly comprising a body and a cover which cover comprises a cover rim having a substantially inverted U-shape defining an outer flange and an inner flange separated by a top section, a lower part of said outer flange terminating in an end, which body comprises a body rim being defined by an upstanding inner wall and an upstanding outer wall, which outer wall being joined to said inner wall by a top wall, a lower portion of said outer wall terminating in a gutter, wherein said outer wall comprises a recess and said outer flange comprises a protrusion in such a manner as to enable a fitting of said protrusion into said recess, said end being provided for engaging said gutter, said outer flange comprises a tab which extends substantially parallel to said top section, said tab being arranged at said lower part of said outer flange and positioned so as to contact the gutter, said outer flange having weakening lines extending substantially vertical on both sides of said tab, so that by applying a pulling force to said tab, a tear out of a section of the outer flange along said weakening lines occurs.

2. The container assembly as claimed in claim 1, characterized in that said weakening lines each being formed by a cut-out, which cut-out being bridged by a bridge extending in line with said end.

3. The container assembly as claimed in claim 2, characterized in that said bridge being formed in a breakable way.

* * * * *